United States Patent [19]

Hoffman et al.

[11] Patent Number: 4,640,309

[45] Date of Patent: Feb. 3, 1987

[54] PILOT OPERATED POPPET VALVE WITH SPEED CONTROL

[75] Inventors: Robert K. Hoffman; Mark A. Kavanaugh, both of Plainwell; David C. Franson, Kalamazoo, all of Mich.

[73] Assignee: Parker Hannifin Corporation, Cleveland, Ohio

[21] Appl. No.: 766,668

[22] Filed: Aug. 15, 1985

Related U.S. Application Data

[62] Division of Ser. No. 508,785, Jun. 29, 1983, abandoned.

[51] Int. Cl.[4] ..... E03B 7/07

[52] U.S. Cl. ..... 137/596.18; 137/596.14; 91/443

[58] Field of Search ..... 137/596.18, 596.14, 137/596.15, 596.16, 513.5, 508; 251/284, 903; 91/443, 447

[56] References Cited

U.S: PATENT DOCUMENTS

| | | | |
|---|---|---|---|
| 2,661,763 | 12/1953 | Renick | 137/508 |
| 2,780,204 | 2/1957 | Barley | 91/443 |
| 2,932,316 | 4/1960 | Stanton | 137/508 |
| 3,318,202 | 5/1967 | Means | 92/245 |
| 3,388,638 | 6/1968 | Brinkel | 92/240 |
| 3,439,583 | 4/1969 | Stacey | 91/447 |
| 3,598,148 | 8/1971 | Kroffke | 137/596.16 |
| 4,161,136 | 7/1979 | Krieger | 137/596.14 |
| 4,203,353 | 5/1980 | Burnham et al. | 92/240 |
| 4,267,861 | 5/1981 | Roth | 251/63 |
| 4,393,751 | 7/1983 | Kelley | 91/443 |
| 4,432,385 | 2/1984 | Legris | 91/443 |
| 4,537,220 | 8/1985 | Anderson | 137/596.14 |

FOREIGN PATENT DOCUMENTS

| | | | |
|---|---|---|---|
| 1139063 | 6/1957 | France | 92/245 |
| 573588 | 11/1945 | United Kingdom | 92/245 |
| 1294747 | 11/1972 | United Kingdom | 137/596.16 |

*Primary Examiner*—Robert E. Garrett
*Assistant Examiner*—John Kwon
*Attorney, Agent, or Firm*—Joseph B. Balazs

[57] ABSTRACT

A pilot-operated poppet valve with integral flow control, the latter being adjustable and direction sensitive to provide free or metered flow. Pressure actuated slidable metering seats having integral lip seals are disposed at load ports and are responsive to pressure therein to move relative to adjustable needles between a metering position and a spaced free flow position. The poppet valves include piston seals consisting of cup-shaped elastomeric elements with a central domed bumper structure disposed freely at the piston head.

3 Claims, 3 Drawing Figures

PILOT OPERATED POPPET VALVE WITH SPEED CONTROL

BACKGROUND OF THE INVENTION

This application is a division of application Ser. No. 508,785, filed June 29, 1983, now abandoned.

This invention relates to a pilot-operated poppet type control valve having an integral direction-sensitive speed control and more specifically to improvements in both the flow control and poppet valve portions of the valve. In the described embodiment of the valve a four-way, four-port, two-position, single solenoid valve is depicted for operating a double acting cylinder from a source of air under pressure, however various other arrangements are possible.

Pilot-operated poppet valves and flow control valves are well known in the art, one such example being shown in U.S. Pat. No. 3,347,259. This patent discusses a solenoid-operated pilot valve in which a functional change between a normally open and normally closed control valve can be made merely by replacement of the poppet structure.

SUMMARY OF THE INVENTION

The present invention is an improvement over prior art structures in providing a poppet valve and speed control valve in a combined structure and further in providing improved poppet and speed control valves which are more economical to manufacture and which are reliable and efficient in operation.

Valves, such as those of the invention, are subject to many different applications and versatility as well as efficiency of design are significant considerations. A poppet valve is typically employed for its full flow capabilities upon minimal stroke and is routinely employed in pneumatic systems for control of high flow levels. One such application of this is control of an actuator cylinder where relatively large volumes of air under pressure must be moved in a relatively short interval. With such high flows, however, is a commensurate fast and full movement of valving elements. It is necessary therefore not only to provide an efficient, economical design, but also to protect the elements therein to provide a long life, reliable structure.

One aspect of the instant invention is a novel bumper seal for the piston of the poppet valve. This seal is an elastomeric one-piece cup-shaped seal which is loosely disposed at the head of the piston to seal the piston bore for actuation of the piston. A lip seal at the periphery thereof provides a unidirectional seal for pilot air pressure but allows the piston to return relatively freely under the urging of a return spring. The seal is self-aligning and normally sits flat against the upper face of the piston during the actuation stroke. The seal also includes a dome-shaped bumper at the central position thereof which protrudes outwardly of the bore to cushion the return stroke of the piston and to prevent the seal from leaving or becoming cocked in the bore.

The speed control valve includes an annular floating valve seat which moves in response to air pressure in the outlet passage to move toward or away from an adjustable needle valve. In one position the seat restricts the flow of air returning from a cylinder, for example, connected to the load port, while in a second position the seat is spaced from the needle valve to provide full flow to the cylinder.

DETAILED DESCRIPTION OF THE INVENTION

Figure 1:
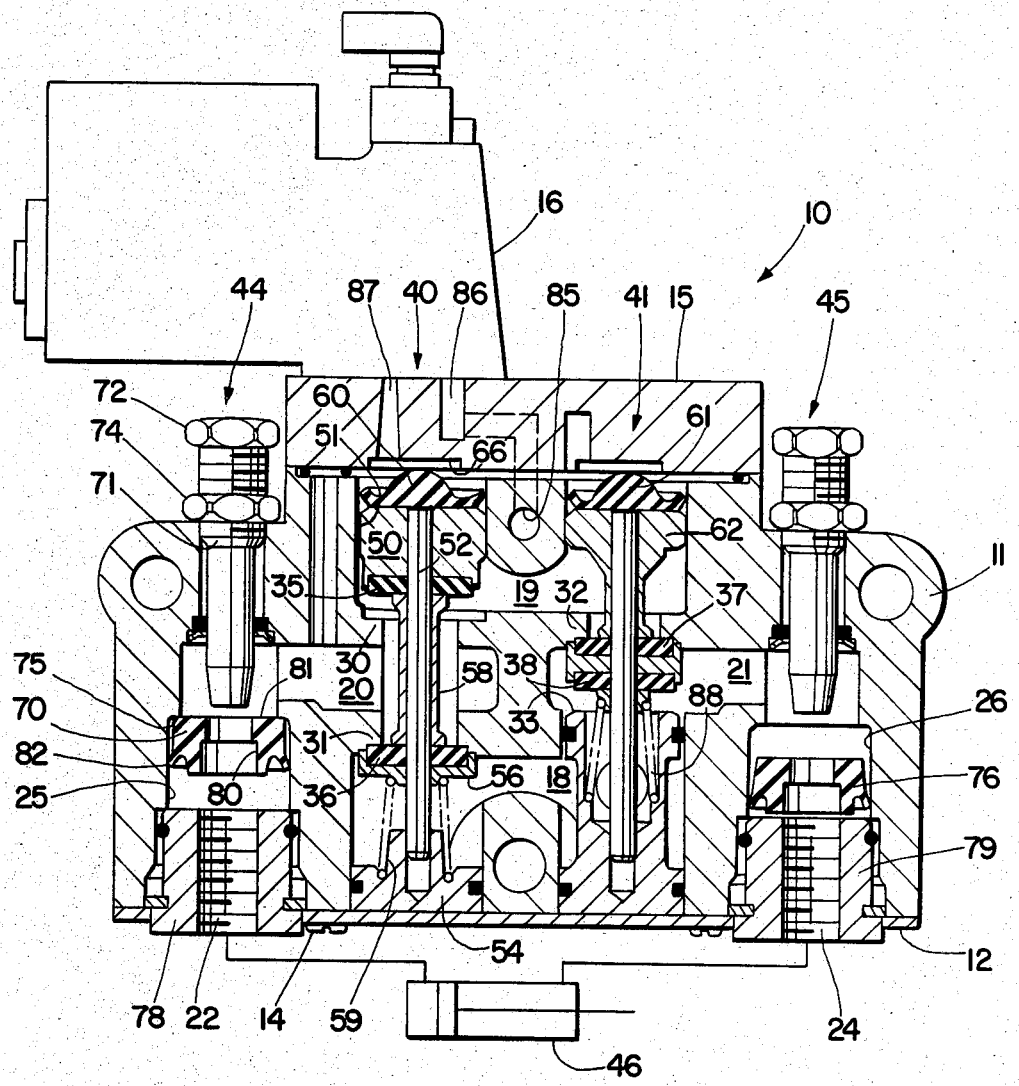
FIG. 1 is a view, partly in cross section, of the poppet valve of the invention, shown in connection schematically with a load cylinder.

Referring now to FIG. 1, there is shown the poppet valve 10 of the invention. The valve 10 includes a valve body 11 and a bottom cover plate 12 which is secured to the body by a plurality of machine screws 14. Valve 10 further includes an adapter plate 15 suitably secured at the top thereof and mounting in turn a solenoid coil and pilot valve 16, the latter serving to control pilot air pressure to the poppet valve, as will be described in greater detail hereafter.

Valve body 11 is of a stacked or manifold mounted configuration wherein additional valve bodies may be mounted in side by side relationship or end manifolds with appropriate pressure and exhaust ports may be connected for supplying air pressure to the valve. Such additional valve bodies would be independent of valve body 11 described, having independent solenoid coils and pilot valves as appropriate, but would be commonly interconnected for the source of air under pressure and for exhaust ports by way of interconnecting internal chambers.

Valve body 11 includes such pressure chamber 18 at the lower portion thereof and exhaust chamber 19 at the upper portion. First and second internal chambers 20, 21, specific to valve body 11 are in fluid communication with output ports 22, 24 respectively by means of stepped bores 25, 26. Poppet valve seats 30, 31, 32, 33 are disposed in valve body 11 between the pressure, exhaust and internal chambers 18, 19, 20, 21 with the flow of fluid therethrough controlled respectively by associated poppet valve seals 35, 36, 37, 38.

In the valve 10 depicted in FIG. 1, two poppet valves 40, 41 and two flow control valves 44, 45 are shown for controlling the speed of actuation of a double acting cylinder 46 in fluid connection at the head end with outlet port 22, and at the rod end with outlet port 24. However only poppet valve 40 and flow control valve 44 will be described in detail since the flow control valves 44, 45 are substantially identical and poppet valves 40, 41 depict merely normally open and normally closed variations of a similar poppet valve configuration.

Poppet valve 40 consists of cylindrical piston 50 slidably disposed in piston bore 51 for movement outwardly and inwardly of valve body 11 in response to pilot air pressure applied at the head of the piston. Poppet pin 52 is fixed in piston 50 and extends downwardly through valve seats 30, 31 for sliding receipt in end cap 54, the latter sealingly retained in a lower bore of valve body 11 and secured by cover plate 12.

Upper poppet seal 35 is retained in a seat at the lower end of piston 50, while lower poppet seal 36 is retained in seal cup 56, the latter slidably disposed on poppet pin 52. Spacer tube 58 separates valve seals 35, 36 while spring 59 acting against the lower end of seal cup 56, urges valve seal 36 against valve seat 31. Spring 59 also urges piston 50 outwardly of bore 51 through the intermediacy of spacer tube 58.

Figure 2:
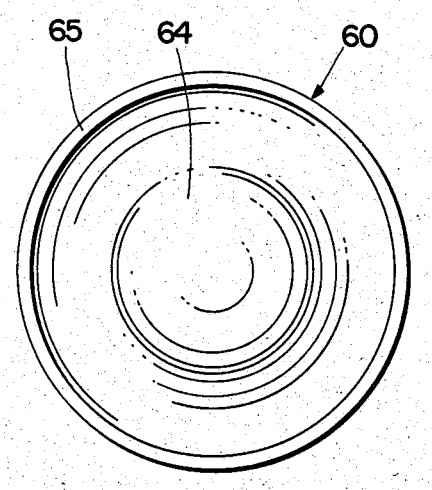
FIG. 2 is a plane view of the bumper seal for sealing the piston of the poppet valve.
Figure 3:
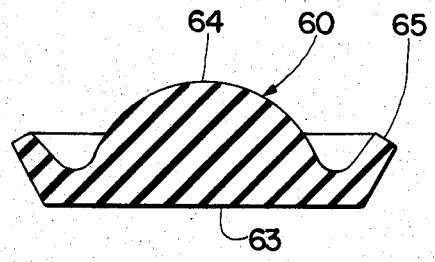
FIG. 3 is an elevational view, in cross section, of the bumper seal.

Bumper seal 60 is also disposed in piston bore 51 for movement with piston 50. A second bumper seal 61 is associated with the piston 62 of poppet valve 41 for sealing its respective piston bore. As seen more clearly in FIGS. 2 and 3, bumper seal 60 comprises a unitary elastomeric structure of generally circular, disc configuration having one flat side 63 and a central raised dome 64 at the opposite side. A raised edge or peripheral ridge 65 protrudes upwardly and radially outwardly from the structure and forms a peripheral lip seal for engagement with the piston bore 51. Side 63 of bumper seal 60 is adapted to lie against the flat upper face of piston 50 and in this manner is prevented from cocking in bore 51. Dome 64 of bumper seal 60 extends further than the extent of lip seal ridge 65 and is adapted to abut the closed end of bore 51. In this embodiment of the invention the closed end of bore 51 is provided by a recess 66 in adapter plate 15. Bumper seal 60 thus provides the function not only of sealing piston bore 51, but also of cushioning the movement of piston 50 in the direction outwardly of body 11. Abutment of dome 64 with recess 66 also prevents lip seal ridge 65 from leaving bore 51 and thereby maintains a sealed engagement therebetween which then is responsive to pilot air pressure. Preferably, bumper seals 60, 61 are formed of 70 durometer Buna-N material.

Flow control valve 44 is disposed in valve body 11 generally within stepped bore 25, and consists of reciprocable valve seal 70 and adjustment needle 71. Needle 71 includes a tapered end and is threadedly mounted in body 11 for adjustment in bore 25 by means of knob 72. Lock nut 74 is provided to secure the position of needle 71 relative to body 11. Bore 25 includes shoulder 75 therein between smaller and larger bore sections and valve seal 70 is disposed in the larger section adapted for movement between a first upper position in engagement with shoulder 75 as depicted at the left side of FIG. 1 and a second lower position. Such lower position is depicted at the right side of FIG. 1 where similar valve seal 76 associated with flow control valve 45 is shown. Threaded outlet port adapters 78, 79 are disposed respectively in outlet ports 22, 24 and limit the lowermost position of valve seals 70, 76, respectively.

Valve seal 70 is an annular member having a central opening 80, flat upper annular face 81 and radially outwardly and depending ridge 82, forming a peripheral lip seal for sealing engagement within bore 25. Valve seal 70 is of sufficient axial length to avoid becoming cocked within bore 25 and lip seal ridge 82 is dimensioned to provide a sufficient fluid seal with bore 25 at the periphery and yet allow sliding movement therein in response to air pressure within bore 25. Preferably valve seal 7 is a unitary structure molded of HYTREL, a polyester elastomer manufactured by E. I. DuPont de Nemours Co.

Thus with valve seal 70 in the uppermost position adjacent shoulder 75, in response to air pressure in bore 25, central opening 80 is adjacent needle 71 and air flow is restricted by the relative positioning therebetween. With the valve seal 70 in the lowermost position central opening 80 is displaced from needle 71 and substantially no restriction is provided to air flow therethrough, allowing substantially free flow of air.

Thus, the mode of operation of poppet valve 10 is depicted in FIG. 1 as described by the following. Air under pressure is supplied at pressure chamber 18, which also is common to internal port 85 and by way of passages in adapter plate 15 is supplied at port 86 to pilot valve 16.

In a de-energized condition of operation no pilot air pressure is applied at outlet port 87 in adapter plate 15 and poppet valves 40, 41 attain their depicted position by means of return spring 59 and corresponding return spring 88 as well as by air pressure in pressure chamber 18. In this condition valve seat 33 is open allowing communication between pressure chamber 18 and internal chamber 21, pressurizing outlet port 24 and the rod end of cylinder 46. Air pressure in bore 26 moves valve seal 76 associated with speed control 45 to the lowermost position spaced from its associated needle and allows free flow of air.

Air from the head end of cylinder 46 is routed to outlet port 22 and through stepped bore 25 and acts upon valve seal 70 to raise same against shoulder 75 bringing central opening 80 into adjacency with needle 71 to restrict air flow therethrough. This return air flow is further routed to internal chamber 20, through open valve seat 30 and to exhaust chamber 19. It will be apparent that a bi-directional flow control over load cylinder 46 may be attained by the structure of the instant invention when a reversal of air flow is made by appropriate energization of poppet valves 40, 41.

What is claimed is:

1. A valve for controlling the flow of fluid to and from a load device, comprising a valve body having pressure and exhaust chambers and an internal chamber therein, a load port to which said load device is connected a fluid passageway between said load port and said internal chamber, a valve seal in said passageway reciprocable between first and second positions in response to fluid pressure at said port, a valve stem in said passageway cooperable with said valve seal for restricting the flow of fluid through said passageway when said valve seal is in said first position therein and for allowing free flow when said valve seal is in said second position, and a pilot operated poppet valve in said valve body for controlling the flow of fluid from said pressure chamber to said internal chamber and from said internal chamber to said exhaust chamber, for alternately pressurizing and exhausting said load device connected to said load port, said poppet valve comprising a piston moveable in a piston bore and spaced valve seals movable with said piston and cooperable with spaced valve seats at ports connecting said internal chamber with said pressure and exhaust chambers, said poppet valve further comprising a bumper seal for said piston, said bumper seal comprising an elastomeric disc having a raised edge for flexible sealing engagement with said piston bore and a raised central bumper portion for cushioning abutment with a closed end of said piston bore, said valve stem and valve seal comprising a speed control valve with said valve seal being annular, having a seal at the periphery thereof and a central opening for fluid flow, said central opening being partly restricted by said valve stem when said valve seal is in said first position to limit the flow of fluid therethrough, said valve stem being adjustably mounted in said valve body for movement toward and away from said central opening in said valve seal, for controlling the flow of fluid at said load port when said valve seal is in said first position.

2. The valve as set forth in claim 1 wherein said piston is biased outwardly of said bore and said central bumper portion of said bumper seal is raised further than said raised edge to prevent said raised edge from leaving said bore.

3. The valve as set forth in claim 1 wherein said valve stem is a needle adapted to project toward said opening in said valve seal for restricting fluid flow, said needle being threadedly engaged in said valve body for adjustment toward said valve seal.

* * * * *